US006443651B1

(12) United States Patent
Greppmair

(10) Patent No.: US 6,443,651 B1
(45) Date of Patent: Sep. 3, 2002

(54) RAMMING DEVICE COMPRISING A VIBRATION REDUCING GUIDE CYLINDER

(75) Inventor: Martin Greppmair, Munich (DE)

(73) Assignee: Wacker-Werke GmbH & Co. KG, Munich (DE)

( * ) Notice: Subject to any disclaimer, the term of this patent is extended or adjusted under 35 U.S.C. 154(b) by 0 days.

(21) Appl. No.: 09/601,291

(22) PCT Filed: Jul. 7, 1999

(86) PCT No.: PCT/EP99/04782

§ 371 (c)(1),
(2), (4) Date: Jul. 27, 2000

(87) PCT Pub. No.: WO00/03096

PCT Pub. Date: Jan. 20, 2000

(30) Foreign Application Priority Data

Jul. 10, 1998 (DE) ..... 198 30 979

(51) Int. Cl.[7] ..... E02D 3/068; E01C 19/30

(52) U.S. Cl. ..... 404/133.05; 404/133.1; 405/271; 74/44

(58) Field of Search ..... 404/133.1, 133.05, 404/133.2; 405/271; 173/170; 74/44

(56) References Cited

U.S. PATENT DOCUMENTS

| | | | | | |
|---|---|---|---|---|---|
| 3,090,286 A | | 5/1963 | Kestel | | |
| 3,277,801 A | * | 10/1966 | Horvath et al. | ..... | 404/133.1 |
| 3,286,790 A | * | 11/1966 | Kestel | ..... | 404/133.1 |
| 3,856,426 A | | 12/1974 | Waschulewski et al. | | |
| 4,014,620 A | | 3/1977 | Vural et al. | | |
| 4,186,197 A | * | 1/1980 | Tetsuo | ..... | 404/133.1 |
| 4,343,568 A | * | 8/1982 | Kaltenegger | ..... | 404/133.1 |
| 5,340,233 A | | 8/1994 | Motl | | |
| 5,645,370 A | | 7/1997 | Zürbes et al. | | |

FOREIGN PATENT DOCUMENTS

| | | | | | |
|---|---|---|---|---|---|
| DE | 1916396 | * | 6/1978 | ..... | 404/133.1 |
| DE | 3439534 | * | 5/1986 | ..... | 404/133.1 |

* cited by examiner

*Primary Examiner*—Heather Shackleford
*Assistant Examiner*—Frederick L. Lagman
(74) *Attorney, Agent, or Firm*—Boyle Fredrickson Newholm Stein & Gratz S.C.

(57) ABSTRACT

A working device, especially a ramming device for compacting soil, comprises a housing which belongs to an upper mass, and has a working mass which can be linearly driven back and forth with regard to the upper mass. The working mass is linearly guided via a guide cylinder which is fastened to the housing with elastic mobility. The transfer of bounce impacts acting upon the working mass to the upper mass can be effectively reduced by the elastic mobility of the guide cylinder with regard to the housing.

15 Claims, 6 Drawing Sheets

RAMMING DEVICE COMPRISING A VIBRATION REDUCING GUIDE CYLINDER

BACKGROUND OF THE INVENTION

1. Field of the Invention

The invention relates to an implement, in particular a ramming device for soil compaction.

2. Description of the Related Art

Known rammers of this type are constructed in such a way that an upper mass which accommodates a motor and a crank drive forming a motion conversion device is connected via a spring set to a working mass that essentially forms a working or compaction plate. The rotational movement produced by the motor is converted by the crank drive into an oscillating axial movement, which is transmitted via the spring set to the working plate for soil compaction.

FIG. 6 shows a rammer of this type, for example disclosed by U.S. Pat. No. 3,090,286.

According to FIG. 6, a drive shaft 1 of the rammer is driven by a motor (not illustrated) and, via a pinion 2, drives a crank disk 4 that is mounted in a rammer housing 3 and provided with external toothing. Fitted to the crank disk 4 is a crank pin 5, on which a connecting rod 6 is fitted such that it can rotate. At its other end, the connecting rod 6 is connected to a guide piston 8 by means of a gudgeon pin 7 such that it can rotate. The guide piston 8 can be moved axially to and fro, with a piston guide 9 that is fixed to it, within a guide tube 10 in a guide cylinder 11 belonging to the lower mass. This axial direction corresponds to a vertical or working direction of the implement during its use.

Arranged on both sides of the piston guide 9 is a spring set 12 comprising one or more springs, the springs in each case being supported on their sides facing away from the piston guide 9 against spring plates 13 fixed to the guide tube 10.

The guide tube 10 and the spring plates 13 belong to the working or lower mass of the rammer. A ramming foot (not illustrated in FIG. 6), which serves for soil compaction, can be fitted to the lower mass. In order to avoid the ingress of moisture and dirt, the upper mass and the lower mass are connected by an elastic bellows 14.

The guide cylinder 11 guiding the guide tube 10 is rigidly connected to the housing 3 by means of bolts 15.

During ramming operation, apart from the vibrations brought about by the acceleration of mass in the ramming system, high impact shocks occur on the rammer as a result of the ramming plate striking the soil—in particular in the case of very hard, stony soil. This problem is further increased in the case of relatively broad ramming plates and by the frequent crooked attitudes brought about by this and, respectively, by forces acting obliquely on the ramming plate.

The impact shocks are transmitted by the ramming plate to the guide tube and the guide cylinder and to the upper mass. As a result, they impair not only the uniform vibrational acceleration of the upper mass but can also considerably impair the durability of the parts incorporated in the upper mass, for example the bearings, the toothing systems and the motor. In addition, the impact shocks also have a negative effect with regard to the spring-mounting of the handle.

OBJECTS AND SUMMARY OF THE INVENTION

According to the invention, an implement, in particular a rammer for soil compaction or a hammer, having an upper mass, which has a drive arranged in or on a housing, having a working mass, which can be driven to and fro linearly by the drive via a motion conversion device and a spring set, and having a guide device, which is fixed to the housing and has a guide cylinder which guides the working mass linearly relative to the housing, is defined by the fact that the guide cylinder is fixed to the housing with elastic mobility, or the guide cylinder itself, given an otherwise rigid connection, has the desired elastic mobility.

The elastic mobility of the guide cylinder relative to the housing belonging to the upper mass or, respectively, the elastic mobility of the guide cylinder itself, permit effective damping of the impact shocks occurring at the working mass, in particular of the shocks which do not act in the vertical direction. Viewed from a vibration point of view, although the guide cylinder also belongs to the upper mass, according to the invention it is decoupled from the remainder of the upper mass, in order to permit the effective dissipation of force peaks.

In a particularly advantageous embodiment of the invention, one or more elastic elements are inserted between the housing and the guide cylinder. By means of suitable selection of the elastic elements, the desired elastic mobility between guide cylinder and housing can be achieved in a straightforward manner. At the same time, it is necessary to be aware that although the elements on the one hand have to provide the necessary elasticity and a corresponding possible deformation travel, on the other hand the guide cylinder still has to be connected rigidly to the housing, in order to ensure the functioning of the implement.

Therefore, a different embodiment can also be advantageous, in which the guide cylinder consists of a polymer and is connected directly to the housing without the interposition of elastic elements. Given appropriate configuration of a fixing flange provided on the guide cylinder, the required elasticity is already achieved by means of the polymer material.

In a particularly advantageous embodiment of the invention, the guide cylinder is firmly held on the housing by means of a clamping ring. The clamping ring makes it possible to interpose the elastic elements in a simple way or directly to retain the fixing flange of a guide cylinder consisting of a polymer.

BRIEF DESCRIPTION OF THE DRAWINGS

These and further advantages and features of the invention will be explained in more detail below with the assistance of the accompanying figures, in which.

DETAILED DESCRIPTION OF THE PREFERRED EMBODIMENTS

FIGS. 1 to 5 show various embodiments of the invention in partial sectional illustration. To the extent that the components have already been described with reference to the known ramming device of FIG. 6, renewed description will be dispensed with. The functioning of all the ramming devices illustrated is identical.

The ramming devices according to the invention from FIGS. 1 to 5 are distinguished by the fact that a guide cylinder is elastically mobile relative to a housing.

Figure 1:
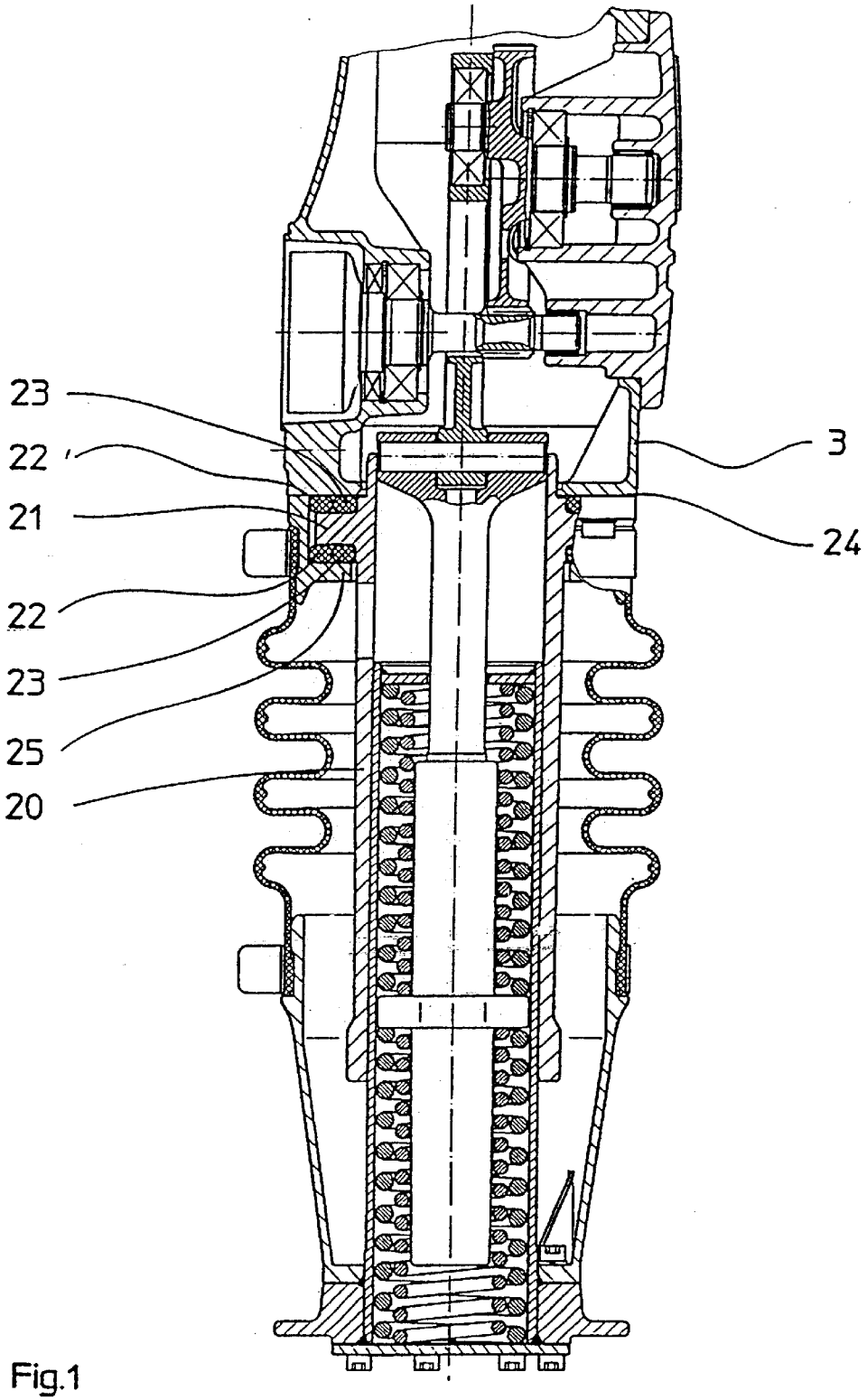
FIG. 1 shows a partial sectional illustration of a first embodiment of the invention.

In FIG. 1, a guide cylinder 20 can be seen on which a fixing flange 21 is formed.

On the ends of the fixing flange 21 that serve as fixing surfaces 22 there bear so-called O rings or round cord rings, which serve as elastic elements 23. The fixing surfaces 22 therefore form contact surfaces with the elastic elements 23. The elastic elements 23 may surround the guide cylinder 20 completely with a constant radius. However, they can also be distributed as individual buffers on the circumference of the guide cylinder 20. Some of the elastic elements 23 rest on a stop surface 24 belonging to the housing 3, while a clamping ring 25 which is screwed to the housing 3 and serves as a fixing device engages behind some others of the elastic elements 23.

As a result of fixing the clamping ring 25 to the housing 3, the elastic elements 23, together with the fixing flange 21 and the guide cylinder 20, are firmly connected to the housing 3, but nevertheless a certain elastic mobility remains between the guide cylinder 20 and the housing 3. This elasticity is suitable to dissipate force peaks brought about by impact shocks and, as a result, to protect the upper mass effectively against shocks.

Figure 2:
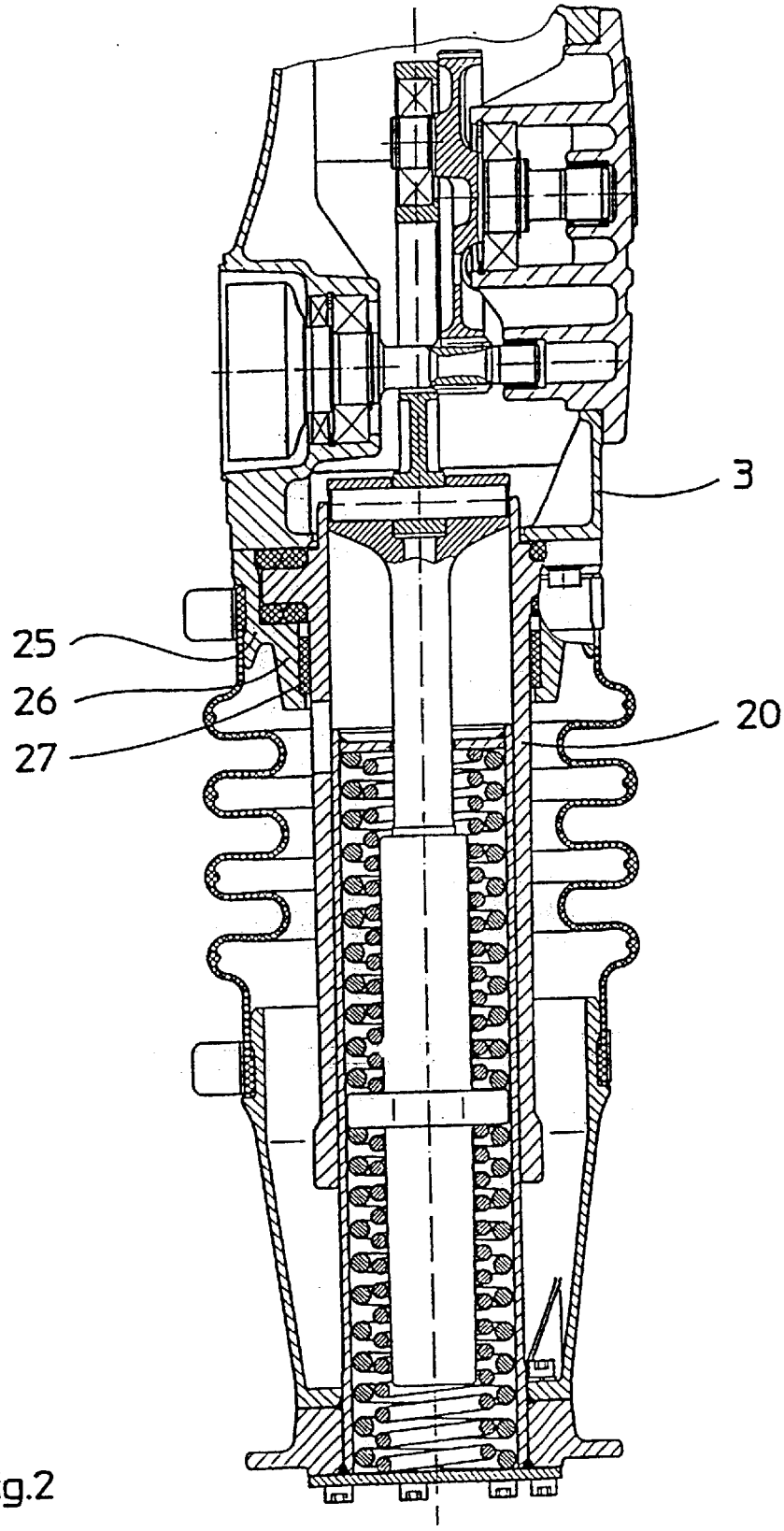
FIG. 2 shows a partial sectional illustration of a second embodiment of the invention.

FIG. 2 shows a different embodiment of the invention, in which, in addition to the solution of FIG. 1, the clamping ring 25 has an extension 26, which surrounds a further elastic element 27 and presses it against the guide cylinder 20.

This variant permits a still more rigid connection between the guide cylinder 20 and the housing 3, whilst maintaining the elastic properties, by which means excessive lateral canting of the guide cylinder 20 with respect to the housing 3 can be avoided.

Figure 3:
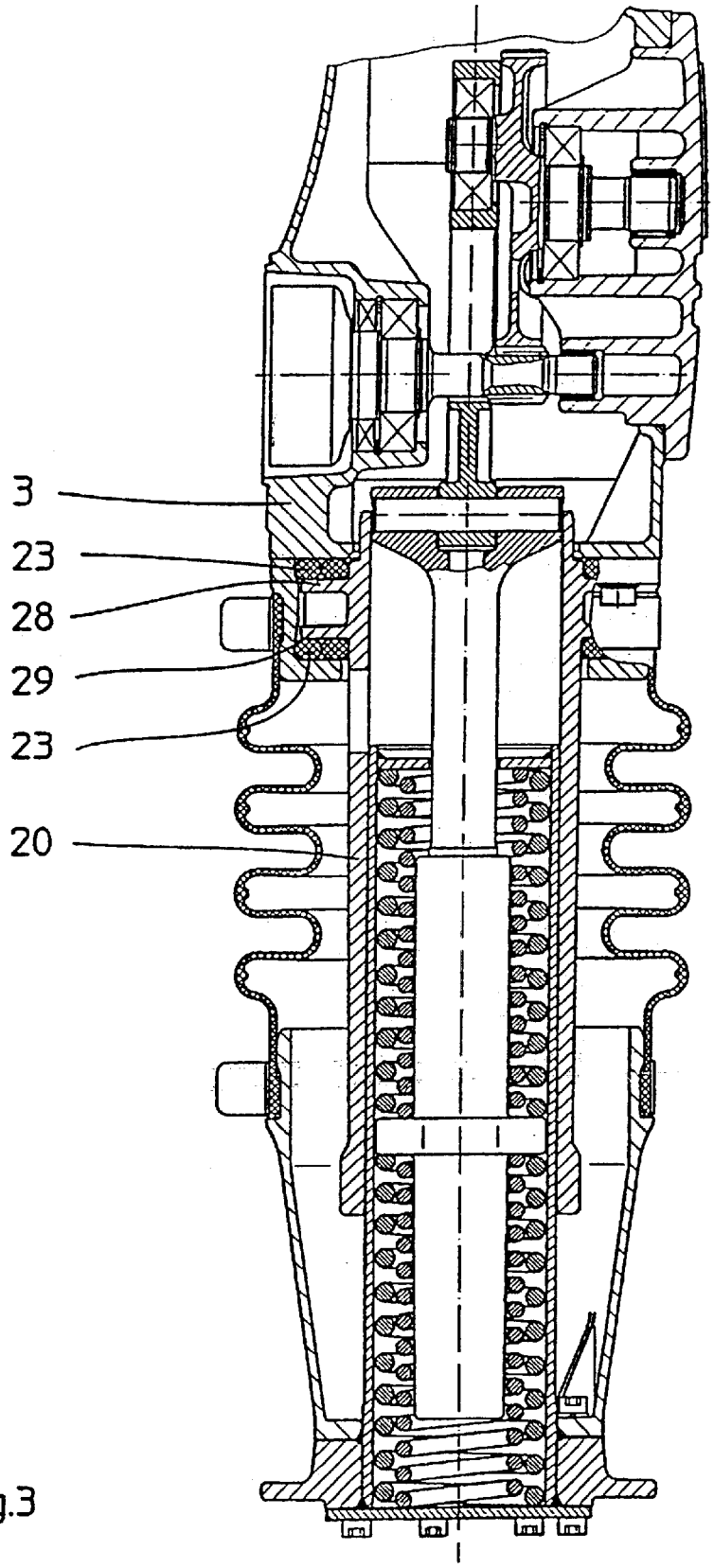
FIG. 3 shows a partial sectional illustration of a third embodiment of the invention.

FIG. 3 shows a third embodiment of the invention, in which the fixing flange 21 known from FIG. 1 has been subdivided into two fixing flanges 28, 29 which are independent of each other, each of the fixing flanges 28, 29 being supported against elastic elements 23 in only one direction.

This solution also corresponds in principle to the first embodiment according to FIG. 1. However, it opens up the possibility of enlarging the distance between the fixing flanges 28 and 29 as desired, in order to increase the rigidity of the connection between the guide cylinder 20 and the housing 3.

Figure 4:
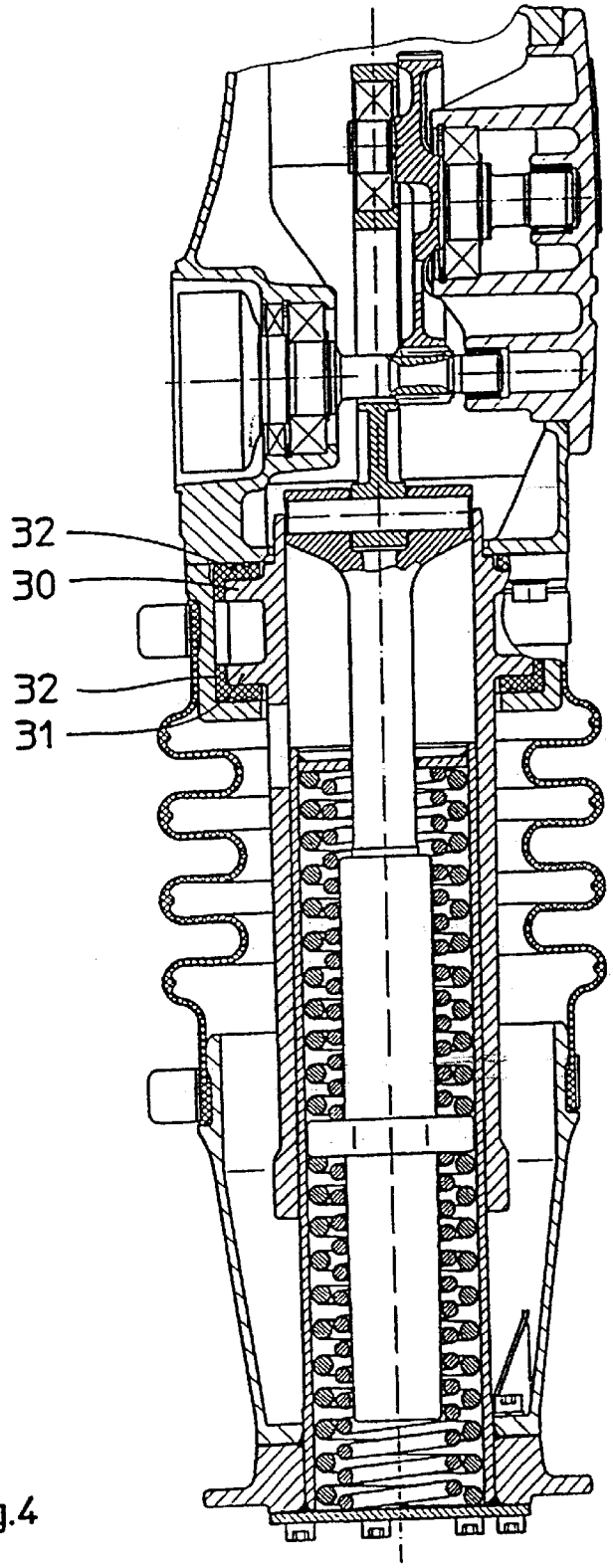
FIG. 4 shows a partial sectional illustration of a fourth embodiment of the invention.

This idea is developed further in the fourth embodiment of the invention according to FIG. 4, in which it is possible to see two fixing flanges 30, 31 which have been drawn far apart from each other. By means of this arrangement it is possible to prevent lateral canting which may possibly occur under extreme loads in the case of the previously described exemplary embodiments.

In the fourth embodiment according to FIG. 4, instead of the previously shown round cord rings 23, elastic elements 32 are also shown, which have been adapted specifically for the intended application as molded rubber parts to be prepared separately. In the embodiment shown in FIG. 4, the elastic elements 32 cover not only the fixing surfaces of the fixing flanges 30, 31 but also the circumferential surfaces, as a result of which in particular lateral shocks can be intercepted better.

Figure 5:
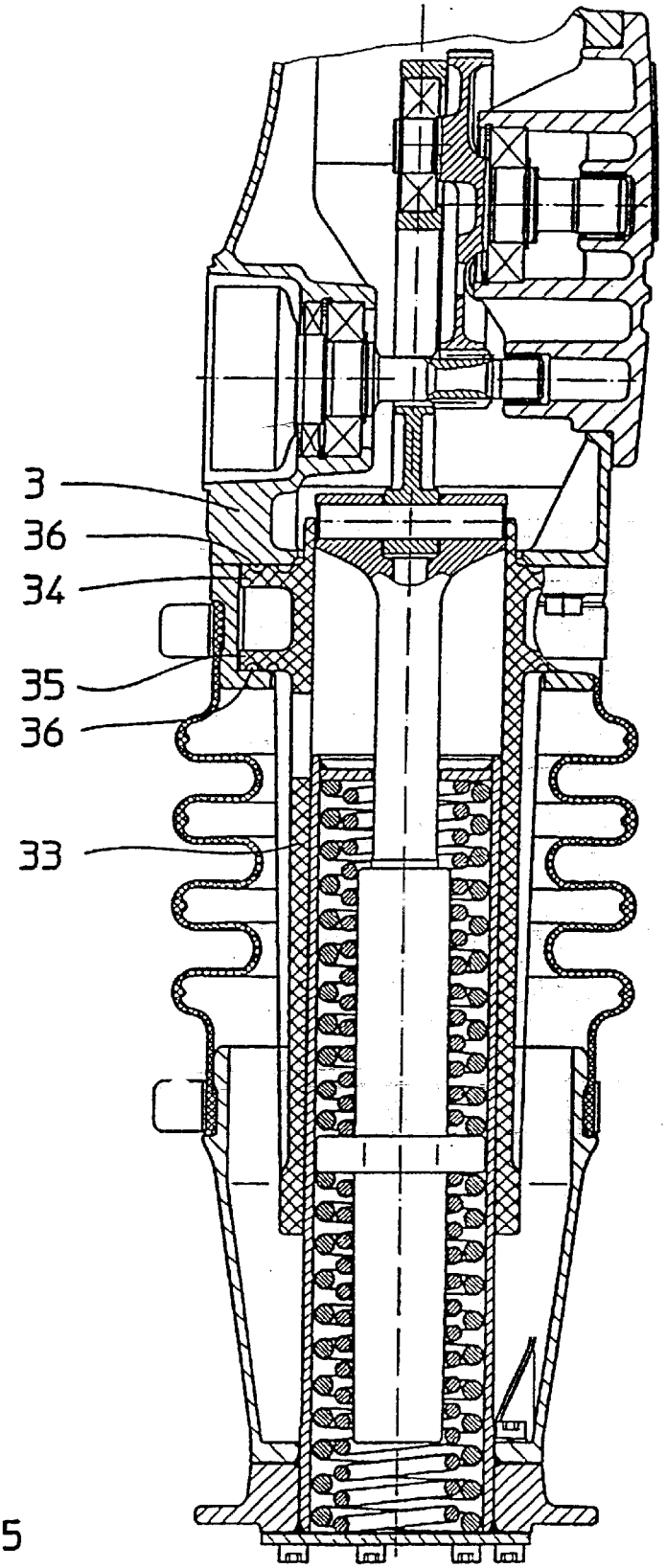
FIG. 5 shows a partial sectional illustration of a fifth embodiment of the invention.
Figure 6:
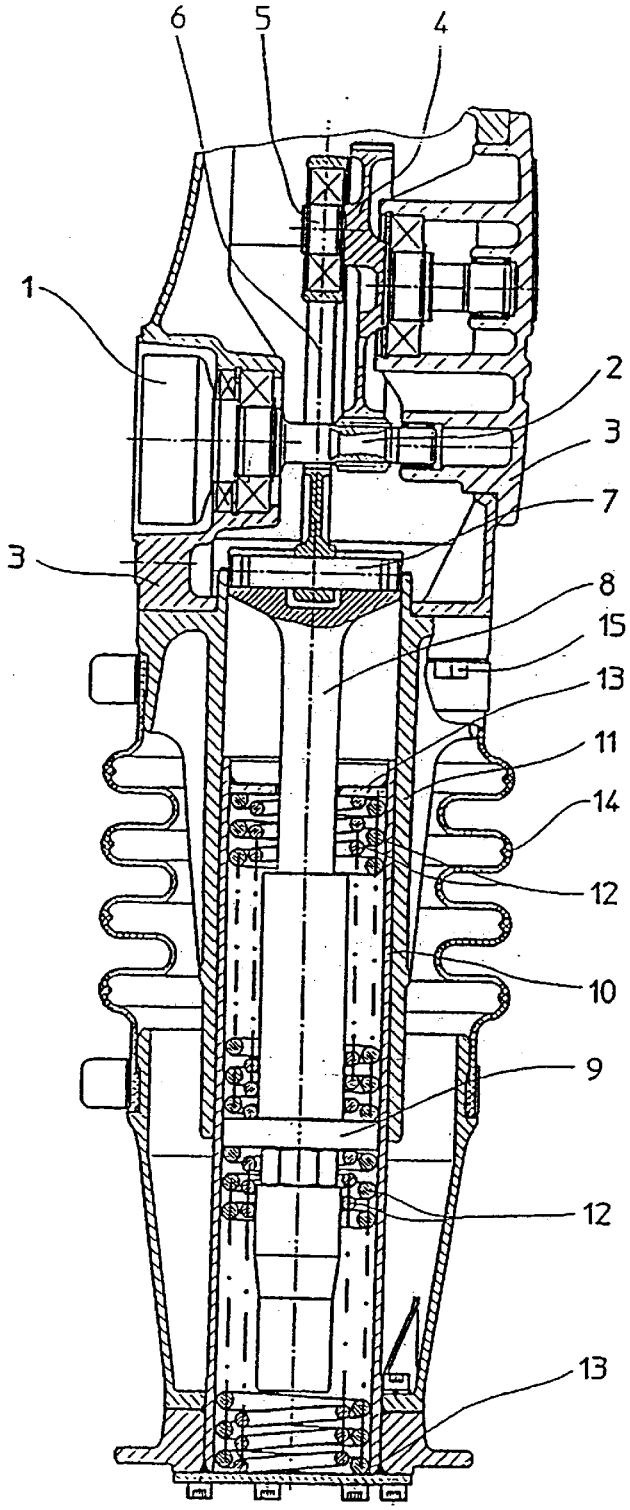
Fig. 6 (Prior Art)
FIG. 6 shows a partial sectional illustration of a known ramming device.

A fifth embodiment is illustrated in FIG. 5.

The rammer shown there has a guide cylinder 33 of a polymer material. The polymer is already sufficiently elastic that, given an otherwise rigid connection between the guide cylinder 33 and the housing 3, the desired elastic mobility can be achieved. For this purpose, the guide cylinder 33—in a way similar to the fourth embodiment according to FIG. 4—has two fixing flanges 34, 35, which should be at not too small a distance from each other.

In order to increase the elasticity, recesses 36 can be formed in the fixing surfaces of the fixing flanges 34, 35, said recesses reducing the effective fixing surfaces and therefore increasing the local surface pressure, an increase in the elasticity within the fixing surfaces being achieved at the same time.

In addition to the advantageous action of the guide cylinder 33 with regard to the damping of impact shocks, considerable advantages in terms of weight also result. Furthermore, the production of a polymer part of this type is simpler than the production of a comparable part of metal.

What is claimed is:

1. An implement, in particular a rammer for soil compaction or hammer, comprising:

an upper mass, which has a drive arranged in or on a housing;

a working mass, which can be driven to and fro linearly by the drive via a motion conversion device and a spring set; and a guide device, which is fixed to the housing and which has a guide cylinder which guides the working mass linearly relative to the housing;

wherein the guide cylinder is fixed to the housing so as to be elastically movable relative thereto.

2. The implement as claimed in claim 1, wherein the guide device has a fixing device which fixes the guide cylinder to the housing.

3. The implement as claimed in claim 2, wherein the guide cylinder has a fixing surface which extends essentially parallel to a stop surface provided on the housing and behind which the fixing device engages.

4. An implement, in particular a rammer for soil compaction or hammer, comprising:

an upper mass, which has a drive arranged in or on a housing;

a working mass, which can be driven to and fro linearly by the drive via a motion conversion device and a spring set; and a guide device, which is fixed to the housing and which has a guide cylinder which guides the working mass linearly relative to the housing;

wherein the guide cylinder is fixed to the housing with elastic mobility, or the guide cylinder itself, given an otherwise rigid connection, has elastic mobility, and wherein at least one elastic element is inserted between the housing and the guide cylinder.

5. The implement as claimed in claim 4, wherein the guide device has a fixing device which fixes the guide cylinder to the housing and wherein at least one elastic element is inserted between the guide cylinder and the fixing device.

6. The implement as claimed in claim 4, wherein the elastic element or element consists or consist of a resilient material or of a polymer.

7. The implement as claimed in claim 4, wherein the guide cylinder has at least one contact surface with one of the elastic elements, said contact surface extending essentially parallel to a stop surface provided on the housing.

8. The implement as claimed in claim 4, wherein the guide cylinder has at least one contact surface in contact with one of the elastic elements, said contact surface extending essentially perpendicular to a stop surface provided on the housing.

9. An implement, in particular a rammer for soil compaction or hammer, comprising:

an upper mass, which has a drive arranged in or on a housing;

a working mass, which can be driven to and fro linearly by the drive via a motion conversion device and a spring set; and a guide device, which is fixed to the housing and which has a guide cylinder which guides the working mass linearly relative to the housing;

wherein the guide cylinder is fixed to the housing with elastic mobility, or the guide cylinder itself, given an otherwise rigid connection, has elastic mobility, wherein the guide cylinder has a fixing device which fixes the guide cylinder to the housing, wherein the guide cylinder has a fixing surface which extends essentially parallel to a stop surface provided on the housing and behind which the fixing device engages; and wherein the fixing surface has elastic properties.

10. The implement as claimed in claim 9, wherein the fixing device comprises a clamping ring.

11. The implement as claimed in claim 10, wherein the guide cylinder consists of a polymer.

12. An implement, in particular a rammer for soil compaction or hammer, comprising:

an upper mass which has a drive arranged in or on a housing;

a working mass which can be driven to and fro linearly by the drive via a motion conversion device and a spring set; and a guide device which is fixed to the housing and which has a guide cylinder which guides the working mass linearly relative to the housing; wherein the guide cylinder is rigidly connected to the housing and consists of a polymer such that it is elastically movable relative to the housing.

13. The implement as claimed in claim 12, wherein the guide cylinder has a fixing surface which extends essentially parallel to a stop surface provided on the housing and behind which a fixing device engages.

14. The implement as claimed in claim 13, wherein the fixing surface has elastic properties.

15. The implement as claimed in claim 13, wherein the fixing device comprises a clamping ring.

* * * * *